US009328394B2

(12) United States Patent
Zotzel et al.

(10) Patent No.: US 9,328,394 B2
(45) Date of Patent: May 3, 2016

(54) AGENT AND METHOD FOR TANNING SKINS AND PELTS

(75) Inventors: Jens Zotzel, Darmstadt (DE); Stefan Marx, Rossdorf (DE); Heinz-Peter Germann, Eningen unter Achalm (DE); Alla Sarafeddinov, Heppenheim (DE)

(73) Assignee: MB-HOLDING GMBH & CO. KG, Vestenbergsgreuth (DE)

( * ) Notice: Subject to any disclaimer, the term of this patent is extended or adjusted under 35 U.S.C. 154(b) by 49 days.

(21) Appl. No.: 12/744,183

(22) PCT Filed: Nov. 21, 2008

(86) PCT No.: PCT/EP2008/065954
§ 371 (c)(1),
(2), (4) Date: Jul. 7, 2010

(87) PCT Pub. No.: WO2009/065915
PCT Pub. Date: May 28, 2009

(65) Prior Publication Data

US 2010/0275380 A1 Nov. 4, 2010

(30) Foreign Application Priority Data

Nov. 23, 2007 (EP) ..... 07121380

(51) Int. Cl.
*C14C 3/10* (2006.01)
*C14C 3/08* (2006.01)
*C14C 3/12* (2006.01)

(52) U.S. Cl.
CPC ... *C14C 3/12* (2013.01); *C14C 3/08* (2013.01); *C14C 3/10* (2013.01)

(58) Field of Classification Search
CPC ..... C14C 3/12; C14C 3/08; C14C 3/10
USPC ..... 8/94.1 R, 94.32, 94.33
See application file for complete search history.

(56) References Cited

U.S. PATENT DOCUMENTS

| | | | | |
|---|---|---|---|---|
| 5,023,024 | A | 6/1991 | Kyogoku et al. | |
| 5,900,027 | A * | 5/1999 | Geihsler et al. | 8/94.19 R |
| 7,063,728 | B2 | 6/2006 | Sundar et al. | |
| 2005/0229324 | A1 * | 10/2005 | Fennen et al. | 8/94.15 |

FOREIGN PATENT DOCUMENTS

| | | | |
|---|---|---|---|
| EP | 1 489 135 | A | 12/2004 |
| GB | 563 288 | A | 8/1944 |
| JP | S62-115100 | | 5/1987 |
| JP | 2001-026518 | A | 1/2001 |
| JP | 2001-181198 | A | 7/2001 |
| RU | 2225451 | | 3/2004 |
| SU | 735636 | | 5/1980 |
| SU | 1141115 | | 2/1985 |

OTHER PUBLICATIONS

Means, Gary E. And Robert E. Feeney. "Chemical modification of proteins" Chapter 1, p. 6, published by Holden-Day in 1971, attached as a PDF to the case file.*

Means et al. bibligrpahic information for the book "Chemical Modification of Proteins", webpage accessed on Google on Jan. 23, 2013, attached in PDF format.*

Ding, K., et al.: "Tanning Potential of Ginipin" American Leather Chemists Association Meeting, Jun. 21, 2006 XP002477562, URL:http://www.are.usda.giviresearch/publications (abstract).

Decision on Grant dated Feb. 27, 2014.

Hiroshi Kuwajima, et al., Biosynthesis of Oleoside-, 10-Hydroxyoleoside- and Ligustaloside- Type Glucosides from Secologanin, Chem. Phar. Bull, vol. 47, No. 11, 1999, pp. 1634-1637.

Notice of Reasons for Rejection in Japanese Patent Application No. 2010-534482, dated Nov. 27, 2012.

* cited by examiner

*Primary Examiner* — Harold Pyon
*Assistant Examiner* — Katie L Hammer
(74) *Attorney, Agent, or Firm* — Venable LLP; Keith G. Haddaway; Annette K. Kwok

(57) ABSTRACT

Process for the tanning of hides and skins, characterized in that hides and skins are treated with tanning agents containing deglycosylated iridoids and/or deglycosylated secoiridoids, excluding tanning agents containing genipin.

20 Claims, 1 Drawing Sheet

AGENT AND METHOD FOR TANNING SKINS AND PELTS

Figure 1:
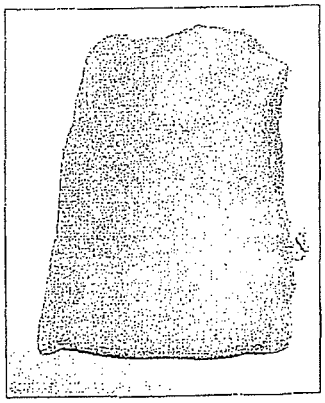

This application is a U.S. national stage of Application No. PCT/EP2008/065954, filed Nov. 12, 2008, which is incorporated herein by reference in its entirety.

The present invention relates to a process for the tanning of hides and skins and to agents for performing the process.

In the tanning process, animal collagen, which is the main component of the skin, is altered in such a way that the leather formed by the tanning exhibits resistance to heat and microorganisms, and the smoothness of the tanned hide is retained after drying.

In essence, three tanning methods are employed today that are based on respectively different cross-linking strategies:

1. Mineral tanning with metal salts (e.g., chromium, iron, aluminum, zirconium salts). The stabilization is due to the fact that metal ions are bound by the amino acid chains in the peptide skeleton of the collagen by complex formation or by ionic interactions.
2. Vegetable tanning with plant extracts (e.g., mimosa, quebracho, chestnut and tara). The stabilization is mainly based on hydrogen bonds between the tanning phenols and the peptide bonds in the skeleton of the collagen.
3. Synthetic tanning with reactive organic compounds (especially with aldehydes, such as glutaraldehyde, or isocyanates). The stabilization is mainly effected through covalent linking of lysine residues of the collagen.

Further, combined tanning methods, such as vegetable-synthetic tanning, are used.

The chromium tanning method has the greatest economic importance with a worldwide proportion of above 90%. The hydrated chromium complexes, which become embedded between the carboxy groups of glutamic acid and aspartic acid of the collagen peptide skeleton, yield a resistant and soft leather. In addition to the good leather quality to be reached, the chromium tanning agent established a rapid and economic process conduct.

The use of heavy metals has a number of drawbacks. For example, it is known that chromium(VI) may cause allergic reactions upon contact with the human skin. Usually, chromium(III) sulfates are employed in the tanning process. However, chromium(VI) may be formed from chromium(III) by oxidation, or it may come into the tanning process through tanning agent impurities.

Further disadvantages of a tanning loaded with chromium or heavy metals include the complicated treatment of the waste waters by a chromium recycling waste water plant, and the expensive disposal of leather scraps, such as shavings, by dumping methods or incineration.

In the American Leather Chemist Association Meeting, Paper No. 17 (2006), "Tanning potential of Genipin", K. Ding, M. M. Taylor and E. M. Brown describe that genipin is suitable as a tanning agent, but yields a dark blue color of the leather.

EP 1 489 135 A1 describes the use of secoiridoids, especially oleuropein, for the cross-linking of biopolymers, for example, β-lactoglobulin, casein and other biopolymers. However, application as a tanning agent for treating leather and hides is not described. It was the object of the present invention to overcome some of the disadvantages of the prior art, especially to develop an ecological tanning process that enables the preparation of high quality tanned hides and skins with reduced amounts of chemicals without causing a dark color of the hides and skins.

This object is achieved by a process for the tanning of hides and skins in which the hides and skins are treated with tanning agents containing deglycosylated iridoids and/or deglycosylated secoiridoids, except for genipin.

Iridoids are secondary plant metabolites found in a wide variety of plant families. They belong to the large group of terpenes or isoprenoids. The designation of the parent compound is derived from the ant species *Iridomyrmex detectus*, which produces the compound in its defensive secretion.

Iridoids typically serve for defense against the plant's predators. However, they also have an antimicrobial effect and offer the plant protection from microorganisms. They have an extraordinarily bitter taste.

Typically, the iridoids in plants are in the form of glycosides, which are typically bound to monosaccharides, for example, glucose, by O-glycosidic bonding.

Cleaving yields the deglycosylated iridoids employed according to the invention.

Preferred substances from the group of deglycosylated iridoids or deglycosylated secoiridoids include, in particular, oleuropeindial and ligustrosidedial and/or ligustalosidedial, decarbomethoxyoleuropeindial and decarbomethoxyligustrosidedial as well as (4E)-4-formyl-3-(1-formyl-2-methoxy-2-oxoethyl)hex-4-enoic acid and (4E)-4-formyl-3-(2-oxoethyl)hex-4-enoic acid. Instead of the free acids, suitable salts, for example, alkali and alkaline earth salts, may also be used. The structures of the two latter mentioned compounds are as follows:

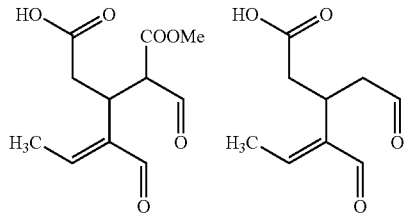

In one embodiment, the compounds employed are those in which at least one aromatic, optionally substituted, benzene ring is present, such as for oleuropeindial and the corresponding derivatives. Preferably, they are phenol derivatives.

Ligustalosides are described, for example, in Hiroshi Kuwajima, Chem. Pharm. Bull. 47 (1999), 1634-1637. The ligustalosidedials are obtained by cleaving the glucose from the ligustaloside.

Typical suitable concentrations of the tanning agents are within a range of from 0.1 to 25% by weight, preferably from 0.5 to 10% by weight. They are typically employed in aqueous solution, optionally with further auxiliary agents.

In principle, a pH within a range of from 1.5 to 11 may be employed, a pH of from 2 to 7 being preferred, however.

Suitable temperatures are within a range of from 4 to 70° C., temperatures of from 10 to 40° C. being particularly preferred.

In a particularly preferred embodiment, the iridoids, the secoiridoids or the correspondingly deglycosylated compounds (aglycons) are of plant origin, especially those derived from plants of the subfamily Oleoideae, especially those obtained from olive leaves, olive waste water or pomace. However, the corresponding iridoids and secoiridoids or their aglycons may also be prepared synthetically. Preferably, the cleavage of the carbohydrates is effected enzymatically.

Iridoids and secoiridoids or their aglycons may also be obtained by fermentation.

In one embodiment, the cross-linking of the proteins of the hides and skins is supported by the addition of further auxiliary agents, for example, by the addition of proteins, peptides, protein hydrolysates, polyamines, chitosan or polylysine.

In one embodiment, the process according to the invention may also be combined with mineral, vegetable and enzymatic tanning.

The invention also relates to a tanning solution containing from 0.1 to 25% by weight of deglycosylated iridoids, deglycosylated secoiridoids or mixtures thereof.

Surprisingly, the tanning processes according to the invention show that cross-linking through hydrogen bonds occurs in addition to covalent cross-linking.

In contrast to the usual vegetable tanning agents whose tanning performance is limited to the hydrogen bonds to the peptide skeleton of the collagen, the covalent bonding yields not only a substantially more stable binding of the tanning agent, but also a significant improvement of the exhaustion of the tanning liquor. The poor tanning agent exhaustion of the liquor with the resulting high COD (chemical oxygen demand) contents of the waste waters is an essential disadvantage of the previously known vegetable tanning.

In contrast to the reactive synthetic organic compounds, such as glutaraldehyde, the process according to the invention not only can dispense with the use of the toxic aldehyde, but it also achieves a more intensive pretanning of the hide. The substances according to the invention additionally show a bulking and fiber-isolating property. This results in a reduced demand for retanning agents having bulking properties or bulking agents in further processing.

According to the invention, the tanning process can dispense with the upstream process of pickling, i.e., the use of acids with sodium chloride, in contrast to the tanning processes industrially employed in the prior art (mineral of chromium tanning, aldehyde (pre)tanning and vegetable-synthetic final tanning). Since the use of high amounts of sodium chloride is avoided, the tannery wastewater is relieved from salt load.

The natural vegetable tanning agent according to the invention provides the leather with a characteristic of ecological compatibility. In addition, the leather obtains a clearly discernible pleasant smell felt as a typical plant smell, in contrast to the offensive smells of chromium tanning.

In the combination with the usual chromium tanning, there are also advantages. There are fields of application in which specific processing or use demands exist, so that the use of the chromium tanning agents cannot be dispensed with (e.g., in the field of shoe upperleathers). The combined use with the process according to the invention has the advantage that radical oxidation processes that may lead to release of toxic and allergenic chromium(VI) from the leather are effectively prevented.

The invention is further illustrated by the following Examples.

FIG. 1: Tanning of cow hide with 4(E)-4-formyl-3-(1-formyl-2-methoxy-2-oxoetheyl)hex-4-enoic acid (Example 1).

Figure 2:
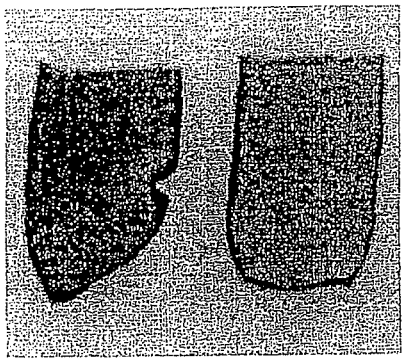

FIG. 2: Tanning of cow hide with genipin (Comparative Experiment).

Example 1

The derivatives (4E)-4-formyl-3-(1-formyl-2-methoxy-2-oxoethyl)hex-4-enoic acid and (4E)-4-formyl-3-(2-oxoethyl) hex-4-enoic acid are typically formed in aqueous solution in the presence of an acidic catalyst. In particular, phosphoric acid, but also sulfuric acid and hydrochloric acid, are suitable for the preparation of the derivatives from oleuropein. A photo of the tanning of cow hide is shown in FIG. 1.

In one embodiment of the preparation process, pH values of from 0.5 to 4, temperatures of from 20 to 80° C. and incubation times of up to 48 hours are preferably employed. The aqueous solution is subsequently adjusted to a pH of 4 to 8. For preparing a powdery formulation, the water is removed by spray-drying. The selection of the process conditions can be effected by the skilled person in accordance with the preparation process.

The incubation of the delimed cow hide with 5% (4E)-4-formyl-3-(1-formyl-2-methoxy-2-oxoethyl)hex-4-enoic acid formulation, 0.1% sodium hexametaphosphate, was effected for 18 hours at 29° C. in 200 ml of water at a pH of 6. The shrinking temperature of the tanned hide was 72° C.

Comparative Experiment

The incubation of the delimed cow hide with genipin was effected for 23 hours at 28° C. at a pH of 6. The shrinking temperature of the tanned hides was 75° C. (left-hand side, 1% genipin) and 63° C. (right-hand side, 0.5% genipin).

The typical dark blue color is shown in FIG. 2.

The invention claimed is:

1. A process for a tanning of hides or skins, comprising the step of pretanning hides or skins with a tanning agent comprising at least one compound selected from deglycosylated iridoids and deglycosylated secoiridoids, said tanning agent not comprising genipin.

2. The process according to claim 1, wherein said tanning agent comprises at least one compound selected from the group consisting of oleuropinedial, ligustrosidedial and ligustalosidedial.

3. The process according to claim 1, wherein said tanning agent comprises a compound selected from the group consisting of decarbomethoxyoleuropeindial and decarbomethoxyligustrosidedial.

4. The process according to claim 1, wherein said tanning agent comprises at least one compound selected from the group consisting of (4E)-4-formyl-3-(1-formyl-2-methoxy-2-oxoethyl)hex-4-enoic acid and (4E)-4-formyl-3-(2-oxoethyl)hex-4-enoic acid or salts thereof.

5. The process according to claim 1, wherein the at least one compound is present in a concentration of from 0.1 to 25% aqueous solution in the tanning agent.

6. The process according to claim 1, wherein the process is performed at a pH of from 1.5 to 11.

7. The process according to claim 1, wherein the process is performed at a temperature of from 4 to 70° C.

8. The process according to claim 1, wherein said deglycosylated iridoids and deglycosylated secoiridoids are of plant origin.

9. The process according to claim 1, wherein said deglycosylated iridoids and deglycosylated secoiridoids are obtained from olive leaves, olive waste water and pomace.

10. The process according to claim 1, wherein said deglycosylated iridoids and deglycosylated secoiridoids are prepared synthetically, enzymatically or by fermentation.

11. The process according claim 1, wherein the tanning is supported by the addition of suitable auxiliary agents.

12. The process according to claim 1, wherein the tanning is supported by the addition of proteins, peptides, protein hydrolysates, polyamines, chitosan or polylysine.

13. The process according to claim 1, wherein the process further comprises mineral, vegetable, or enzymatic tanning.

14. The process according to claim 1, wherein the hides or skins are not darkened.

15. A tanning agent comprising 0.1 to 25% by weight of a compound selected from the group consisting of oleuropeindial, ligustrosidedial and ligustalosidedial.

16. A tanning agent comprising 0.1 to 25% by weight of a compound selected from the group consisting of decarbomethoxyoleuropeindial and decarbomethoxyligustrosidedial.

17. A tanning agent comprising 0.1 to 25% by weight of a compound selected from the group consisting of (4E)-4-formyl-3-(1-formyl-2-methoxy-2-oxoethyl)hex-4-enoic acid, (4E)-4-formyl-3-(2-oxoethyl)hex-4-enoic acid and salts thereof.

18. The process of claim 1, wherein the at least one compound is present in a concentration of from 0.5% to 10% aqueous solution in the tanning agent.

19. The process of claim 1, wherein the process is performed at a pH of from 2 to 7.

20. The process of claim 1, wherein the process is performed at a temperature of from 10 to 40° C.

* * * * *